US005941732A

United States Patent [19]

Okamura

[11] Patent Number: 5,941,732

[45] **Date of Patent: *Aug. 24, 1999**

[54] CONNECTOR WITH PLANAR RIDGE ON INNER WALL OF CONNECTOR HOUSING

[75] Inventor: Masahiko Okamura, Shizuoka, Japan

[73] Assignee: Yazaki Corporation, Tokyo, Japan

[ * ] Notice: This patent is subject to a terminal disclaimer.

[21] Appl. No.: 08/955,720

[22] Filed: Oct. 22, 1997

Related U.S. Application Data

[63] Continuation of application No. 08/723,884, Sep. 23, 1996, abandoned.

[30] Foreign Application Priority Data

Sep. 25, 1995 [JP] Japan ..... 7-246143

[51] Int. Cl.[6] ..... H01R 13/40

[52] U.S. Cl. ..... 439/598

[58] Field of Search ..... 439/598, 701, 439/374

[56] References Cited

U.S. PATENT DOCUMENTS

| | | | |
|---|---|---|---|
| 3,101,229 | 8/1963 | Yopp | 439/595 |
| 3,518,617 | 6/1970 | Busworth et al. | 439/346 |
| 5,100,336 | 3/1992 | Burgess et al. | 439/364 |

FOREIGN PATENT DOCUMENTS

| | | | |
|---|---|---|---|
| 2-278672 | 11/1990 | Japan | H01R 13/46 |

*Primary Examiner*—Neil Abrams
*Assistant Examiner*—T C Patel
*Attorney, Agent, or Firm*—Sughrue, Mion, Zinn, MacPeak & Seas, PLLC

[57] ABSTRACT

In a connector, a terminal plate, having terminals projecting therefrom, is fitted in a housing. Flat surfaces parallel to a direction of insertion of the terminal plate are formed on inner surfaces of the housing. Flat surfaces are also formed on an outer surface of the terminal plate, and contact the flat surfaces of the housing, respectively, to thereby prevent the terminal plate from shaking. Preferably, two pairs of parallel flat surfaces are formed on the inner surface of the housing, and two pairs of parallel flat surfaces are formed on the outer surface of the terminal plate.

7 Claims, 4 Drawing Sheets

CONNECTOR WITH PLANAR RIDGE ON INNER WALL OF CONNECTOR HOUSING

This is a continuation of application Ser. No. 08/723,884, filed Sep. 23, 1996 abandoned.

FIELD OF THE INVENTION

This invention relates to a connector in which a terminal plate, having terminals projecting therefrom, is fitted in a housing, and more particularly to a construction for preventing the shaking of the terminal plate in such a fitted condition.

DESCRIPTION OF THE PRIOR ART

In one conventional connector used, for example, in a transmission of an automobile engine, a terminal plate, having terminals projecting therefrom, is fitted in a housing. FIG. 6 is a perspective view of such a conventional connector having the terminal plate fitted therein, and FIG. 7 is an enlarged view showing a shaking prevention rib of the conventional connector.

The housing 3 of the conventional connector 1 has a tubular shape, and upper, lower, right and left inner wall surfaces 3*a*, 3*b*, 3*c* and 3*d* of this housing are curved outwardly. Four corner portions, each defining the boundary between the corresponding adjacent ones of the upper, lower, right and left inner wall surfaces, are also curved in continuous relation to the corresponding adjacent inner wall surfaces. The front side of the housing 3 is open to provide a connector opening 5, and a mating connector (not shown) is adapted to be fitted in this connector opening 5.

The terminal plate 9, having the terminals 7 projecting therefrom, is inserted into the housing through the connector opening 5. Upper, lower, right and left outer surfaces 9*a*, 9*b*, 9*c* and 9*d* of the terminal plate 9 are curved, and correspond in curvature to the inner wall surfaces of the housing 3, respectively. After the terminal plate 9 is inserted into the housing 3 through the connector opening 5, the terminal plate 9 is fixed within the housing 3 by engagement means (not shown). When the terminal plate 9 is thus fixed within the housing 3, the terminals 7 are disposed in the connector opening 5 (see FIG. 6) so that this connector can be connected to the mating connector. Shaking prevention ribs 11 each in the form of a small, rail-like projection extending in a direction of insertion of the terminal plate 9 are formed on the outer surfaces of the terminal plate 9, and when the terminal plate 9 is inserted into the housing 3, the shaking prevention ribs 11 contact the inner wall surfaces of the housing 3, and are present in a small gap between the inner peripheral surface of the housing 3 and the outer peripheral surface of the terminal plate 9, thereby preventing the shaking of the terminal plate 9.

In the conventional connector 1 of this construction, the inner wall surfaces of the housing 3 correspond in curvature to the outer surfaces of the terminal plate 9, respectively, and the shaking prevention ribs 11 contact the inner wall surfaces of the housing 3, thereby absorbing the gap between the terminal plate 9 and the inner peripheral surface of the housing 3, and therefore the terminal plate 9 can be housed in the housing 3 without shaking.

In the conventional connector, however, the inner wall surfaces 3*a*, 3*b*, 3*c* and 3*d* of the housing 3, as well as the outer surfaces 9*a*, 9*b*, 9*c* and 9*d* of the terminal plate 9, are curved, and the housing 3 and the terminal plate 9 contact each other at their curved surfaces. Therefore, if dimensional inaccuracy due to dimensional tolerance develops (or the inserted terminal plate 9 is disposed out of position relative to the connector opening 5), the mating contact surfaces can be easily brought into point contact with each other, and a gap is formed between the fitting surfaces, so that the shaking prevention ribs 11 fail to sufficiently contact the inner wall surfaces of the housing. This results in the terminal plate 9 shaking within the housing 3.

SUMMARY OF THE INVENTION

The present invention has been made in view of the foregoing, and an object of the invention is to provide a connector in which a terminal plate is prevented from shaking within a housing, thereby ensuring a positive fitting condition.

According to the present invention, there is provided a connector comprising: a terminal plate having a straight surface on an outer peripheral surface thereof; and a housing into which the terminal plate is inserted, the housing having a flat surface so as to be formed parallel to a direction of insertion of the terminal plate on an inner surface of the housing; wherein the straight surface contacts the flat surface to prevent the terminal plate from shaking.

When the terminal plate is inserted into the housing, the flat surfaces of the terminal plate contact the flat surfaces of the housing, respectively, and this surface contact prevents the terminal plate from shaking, thus positioning the terminal plate. The terminal plate and the housing contact each other at their flat surfaces, and therefore a gap (due to dimensional inaccuracy or the like) between the fitting surfaces is reduced to a smaller level as compared with the conventional construction in which the mating curved surfaces contact each other, and therefore the terminal plate is prevented from shaking relative to the housing.

DETAILED DESCRIPTION OF THE PREFERRED EMBODIMENTS

A preferred embodiment of a connector of the present invention will now be described with reference to the drawings.

Figure 1:
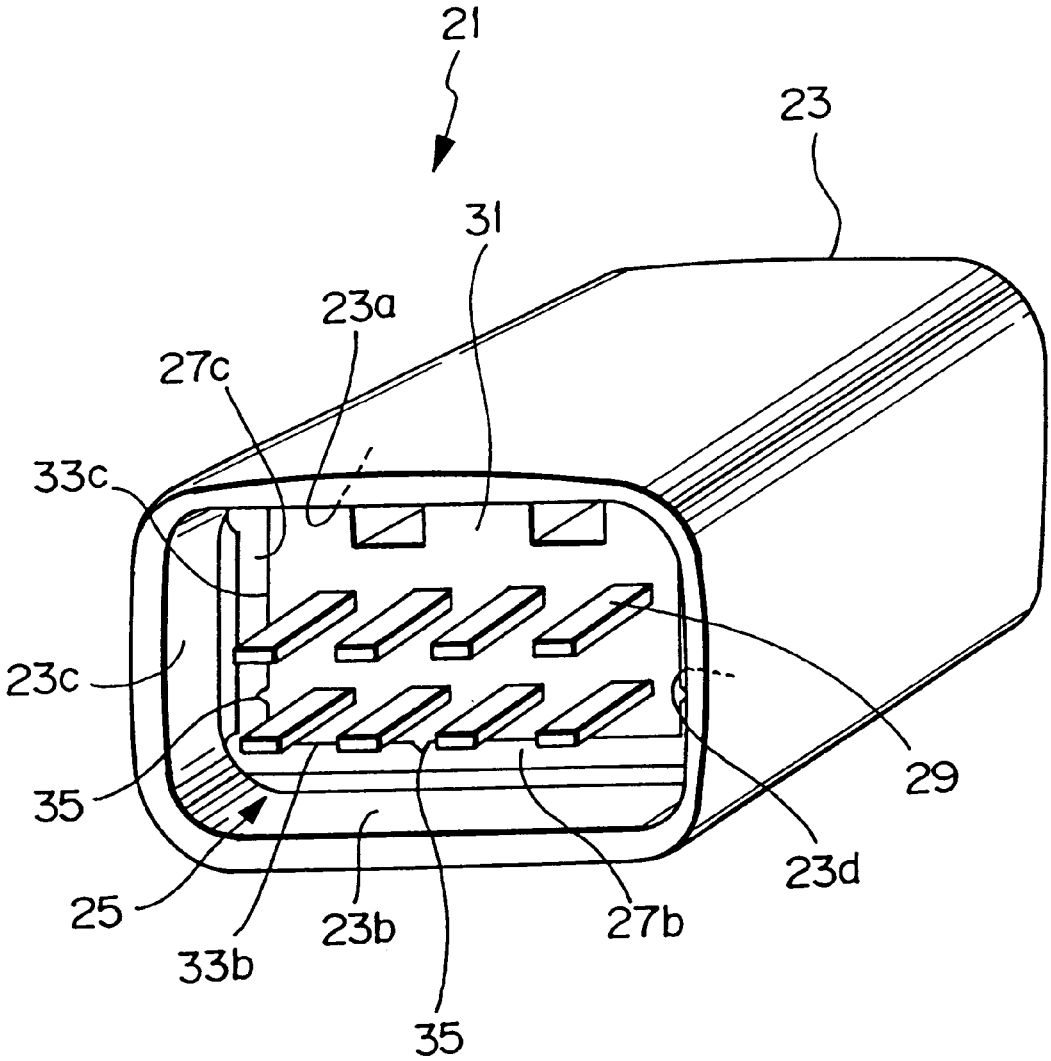
FIG. 1 is a perspective view showing the appearance of a connector of the present invention.
Figure 2:
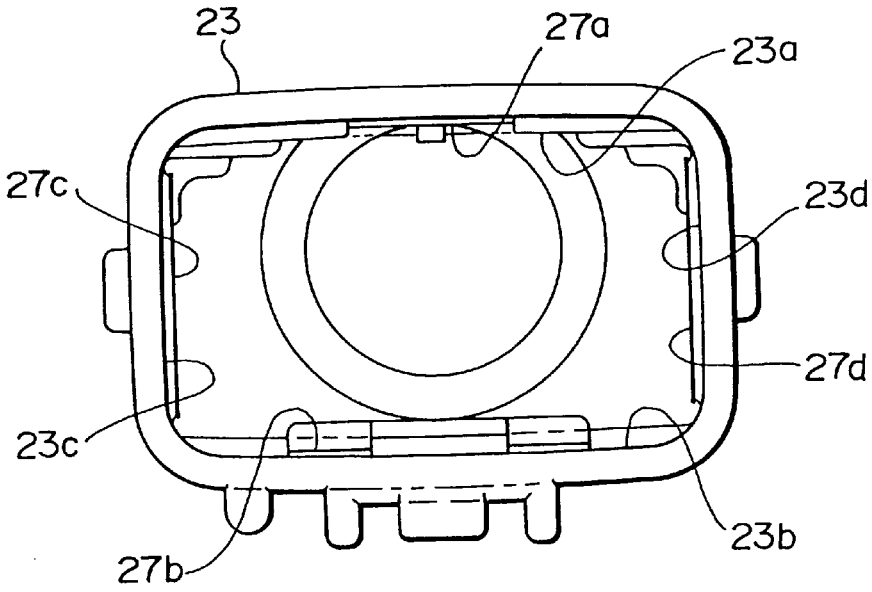
FIG. 2 is a front plan view of a housing of the connector of the invention.
Figure 3:
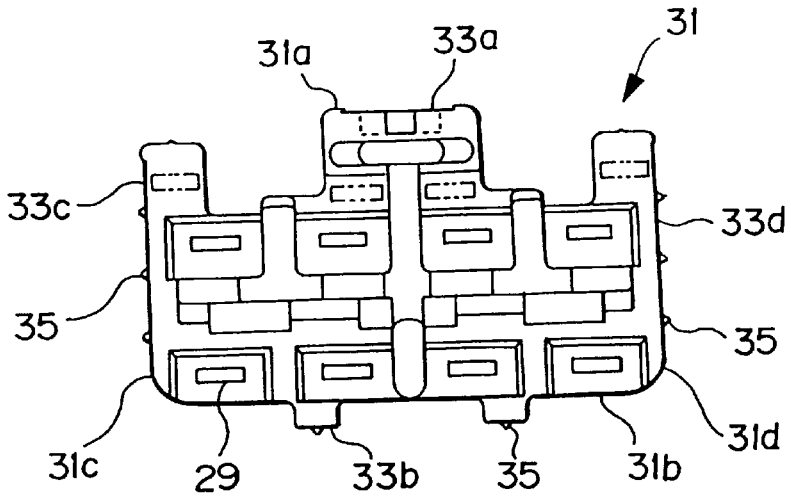
FIG. 3 is a front plan view of a terminal plate of the connector of the invention.
Figure 4:
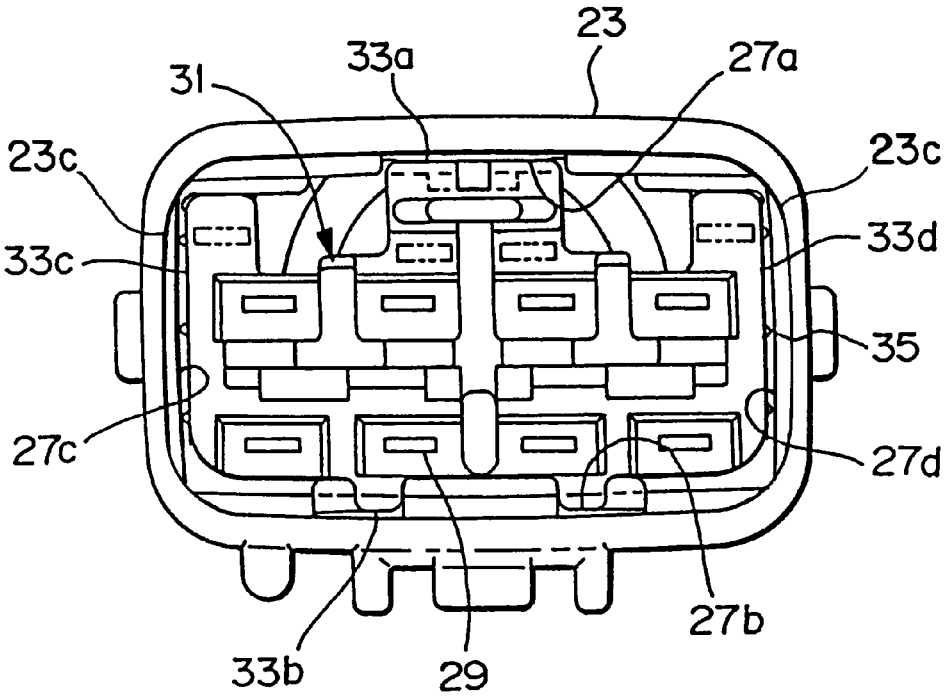
FIG. 4 is a front plan view of the connector of the invention having the terminal plate fitted therein.
Figure 5:
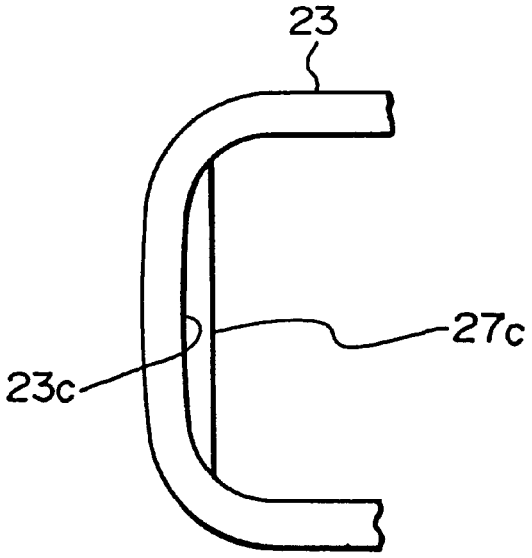
FIG. 5 is a view showing a curved inner wall surface of the housing.
Figure 6:
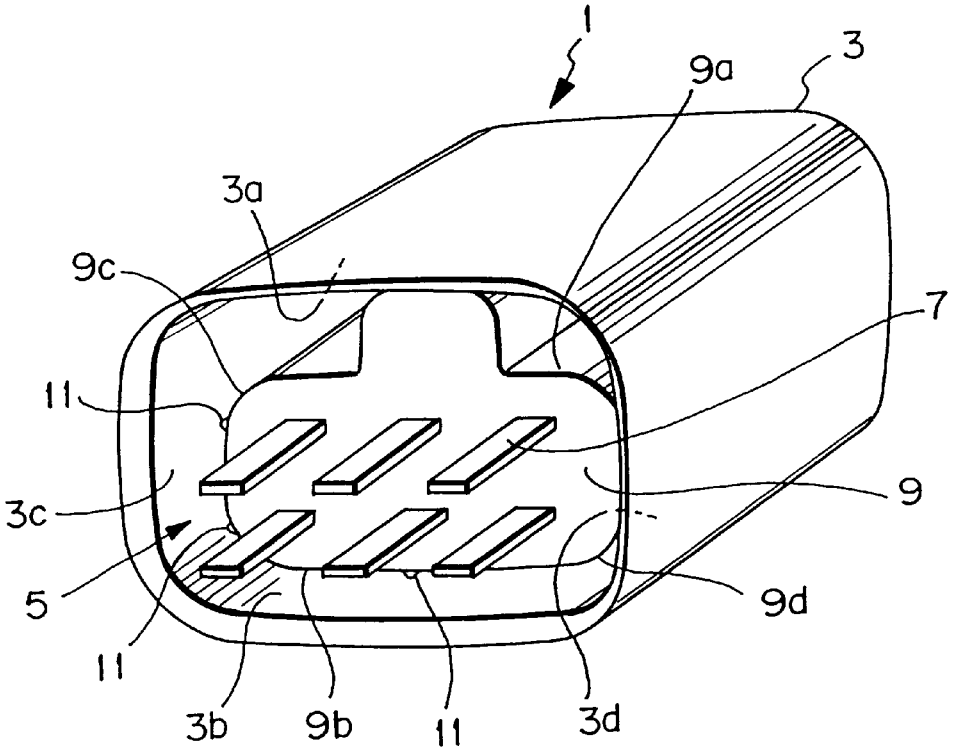
FIG. 6 PRIOR ART
FIG. 6 is a perspective view of a coniventional connector having a terminal plate fitted therein.
Figure 7:
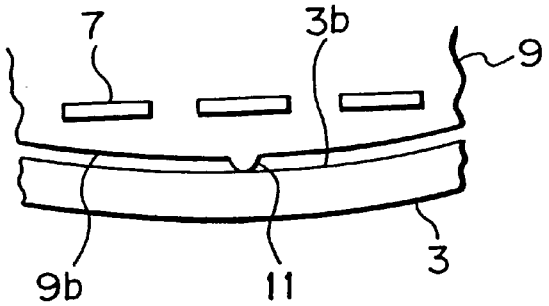
FIG. 7 PRIOR ART
FIG. 7 is an enlarged view showing a shaking prevention rib of the conventional connector.

FIG. 1 is a perspective view showing the appearance of the connector of the invention, FIG. 2 is a front plan view of a housing of the connector, FIG. 3 is a front plan view of a terminal plate of the connector, FIG. 4 is a front plan view of the connector having the terminal plate fitted therein, and FIG. 5 is a view showing a curved inner wall surface of the housing.

The housing 23 of the connector 21 has a tubular shape, and upper, lower, right and left inner wall surfaces 23*a*, 23*b*, 23*c* and 23*d* of this housing are flat as shown in FIG. 2, or are curved outwardly as shown in FIG. 5. Four corner portions, each defining the boundary between the corresponding adjacent ones of the upper, lower, right and left inner wall surfaces, are curved in continuous relation to the corresponding adjacent inner wall surfaces. The front side of the housing 23 is open to provide a connector opening 25, and a mating connector (not shown) is adapted to be fitted in this connector opening 25.

As shown in FIG. 2, a flat surface 27*a* is formed on the upper inner wall surface 23*a* of the housing 23, and flat surfaces 27*b* parallel to the flat surface 27*a* are formed on the lower inner wall surface 23*b* of the housing 23, and the flat surfaces 27*a* and 27*b* are formed at least on those portions of these inner wall surfaces at which the inserted terminal plate is disposed. Flat surfaces 27*c* and 27*d* parallel to each other are formed respectively on the left and right inner wall surfaces 23*c* and 23*d* of the housing 23 in such a manner that they are projected toward the axis of the housing 23, and the flat surfaces 27*c* and 27*d* are respectively formed at least on those portions of these inner wall surfaces at which the inserted terminal plate is disposed. These flat surfaces 27*a*, 27*b*, 27*c* and 27*d* define reference surfaces which the terminal plate contact. Namely, the reference surfaces are provided (in X-axis and Y-axis directions) respectively on the upper, lower, right and left sides of the internal space of the housing 23 into which the terminal plate is inserted.

The terminal plate 31, having terminals 29 projecting therefrom, is inserted into the housing 23 through the connector opening 25. As shown in FIG. 3, a straight surface 33*a* is formed on an upper outer surface 31*a* of the terminal plate 31, and straight surfaces 33*b* parallel to the straight surface 33*a* are formed on a lower outer surface 31*b* of the terminal plate 31. When the terminal plate 31 is inserted into the housing 23, the flat surface 33*a* is disposed in surface-contact with the flat surface 27*a* of the housing 23, and also the straight surfaces 33*b* are disposed in surface-contact with the flat surfaces 27*b* of the housing 23, respectively. Straight surfaces 33*c* and 33*d* parallel to each other are formed respectively on left and right outer surfaces 31*c* and 31*d* of the terminal plate 31, and when the terminal plate 31 is inserted into the housing 23, the straight surfaces 33*c* and 33*d* are disposed in surface-contact with the flat surfaces 27*c* and 27*d* of the housing 23. Namely, the terminal plate 31 is inserted into the housing 23, with their four outer surfaces in contact with the flat surfaces of the housing 23.

Shaking prevention ribs 35 each in the form of a small, rail-like projection extending in a direction of insertion of the terminal plate 31 are formed on the straight surfaces 33*a*, 33*b*, 33*c* and 33*d*, and when the terminal plate 31 is inserted into the housing 23, the shaking prevention ribs 35 contact the flat surfaces 27*a*, 27*b*, 27*c* and 27*d*, thereby preventing the terminal plate 31 from shaking. The shaking prevention ribs 35 are snugly disposed in dimensionaly-inaccurate regions (that is, a gap between the housing 23 and the terminal plate 31) due to dimensional tolerance, and serve to contact them with each other, thereby preventing the shaking.

The operation of the connector 21 of this construction will now be described.

When the terminal plate 31 is inserted into the housing 23, the upper and lower straight surfaces 33*a* and 33*b* of the terminal plate 31 are disposed in contact with the flat surfaces 27*a* and 27*b* of the housing 23, and also the left and right straight surfaces 33*c* and 33*d* are disposed in contact with the flat surfaces 27*c* and 27*d* of the housing 23, respectively. Therefore, by this surface contact, the terminal plate 31 is prevented from being displaced in upward, downward, right and left directions (that is, the X-axis and Y-axis directions), and is positioned as shown in FIG. 4.

The terminal plate 31 and the housing 23 contact each other at their upper, lower, right and left flat and straight surfaces, and with this arrangement the gap (due to dimensional inaccuracy or the like) between the fitting surfaces can be reduced to a smaller level as compared with the conventional construction in which the mating curved surfaces contact each other, and all of the shaking prevention ribs 35 are always held in contact with the fitting surface. Therefore, the incomplete contact of the shaking prevention ribs 35 due to the gap is eliminated, so that the terminal plate 31 will not shake relative to the housing 23. Namely, the flat and straight surfaces prevent the terminal plate 31 and the housing 23 from shaking relative to each other, so that the terminal plate 31 is always located at the predetermined position, and therefore the shaking prevention ribs 35 fully perform their intended function.

In the above embodiment, although the inner wall surfaces of the housing 23 on which the flat surfaces 27*c* and 27*d* are formed, respectively, are flat, the inner wall surfaces of the housing 23 may be curved outwardly as shown in FIG. 5. In this case, also, the straight surfaces 27*c* and 27*d* are projected toward the axis of the housing 23 as in the above embodiment.

In the above embodiment, the mating flat and straight surfaces contact each other for the purpose of keeping all of the shaking prevention ribs 35 in the contacted condition. However, the construction of the connector of the present invention is advantageous even if the shaking prevention ribs 35 are not provided. In this case, the terminal plate 31 and the housing 23 directly contact each other at their flat and straight surfaces, and are prevented from moving relative to each other. In this case, although there is no gap-absorbing effect by the shaking prevention ribs 35, the shaking is prevented by the direct contact of the flat and straight surfaces with each other.

As described above, in the connector of the present invention, the flat surfaces are formed on the inner surface of the housing, and the flat surfaces, formed on the outer surface of the terminal plate, contact the flat surfaces of the housing, respectively, to thereby prevent the terminal plate from shaking. Thus, this surface contact prevents the terminal plate, inserted into the housing, from moving, and positions the terminal plate. Therefore a gap (due to dimensional inaccuracy or the like) between the fitting surfaces is reduced to a smaller level as compared with the conventional construction in which the mating curved surfaces contact each other, and therefore the terminal plate is prevented from shaking, and positive fitting can be achieved.

What is claimed is:

1. A connector comprising:

a terminal plate having at least one substantially straight peripheral surface; and a housing into which said terminal plate is inserted, said housing having at least one arcuate outer wall having a substantially vertical portion, and a corresponding vertical inner wall, and a ridge extending inwardly from said vertical inner wall of said housing, said ridge disposed continuously and uniformly over said vertical inner wall of said housing, an inner surface of said ridge within said housing, being substantially planar;

wherein, upon insertion of said terminal plate into said housing, said straight peripheral surface of said terminal plate abuts flush against said inner surface of said ridge to prevent said terminal plate from shaking in the housing.

2. A connector according to claim 1, wherein said at least one arcuate outer wall and corresponding vertical inner wall of said housing with said inwardly extending ridge, number at least one pair, and said pair of ridges are parallel to each other, and said terminal plate has two pairs of straight peripheral surfaces which are parallel to each other, and said two pairs of said straight peripheral surfaces abut flush against the corresponding pairs of said at least one of inner walls and ridges, respectively.

3. A connector according to claim 1, wherein a rail-like projection extending in the direction of insertion of said terminal plate is formed on said peripheral surface of said terminal plate, and said terminal plate contacts said ridge of said housing through said rail-like projection.

4. A connector according to claim 2, wherein a rail-like projection extending in the direction of insertion of said terminal plate is formed on said penpheral surfaces of said terminal plate, and said terminal plate contacts said each of said rides of said housing through said rail-like projection.

5. A connector according to claim 1, wherein said ridge projects from said inner wall of said housing.

6. A connector according to claim 3, wherein said ridges project from said inner walls of said housing.

7. A connector comprising:

a terminal plate having at least one substantially straight peripheral surface and a rail-like projection extending outwardly from said straight peripheral surface; and a housing into which said terminal plate is inserted, said housing having at least one arcuate outer wall having a substantially vertical portion, and a corresponding vertical inner wall, and a ridge extending inwardly from said vertical inner wall of said housing, said ridge disposed continuously and uniformly over said vertical inner wall of said housing, an inner surface of said ridge within said housing, being substantially planar;

wherein, upon insertion of said terminal plate into said housing, said rail-like projection contacts said inner surface of said ridge to prevent said terminal plate from shaking in said housing.

* * * * *

UNITED STATES PATENT AND TRADEMARK OFFICE

CERTIFICATE OF CORRECTION

PATENT NO. : 5,941,732

DATED : August 24, 1999

INVENTOR(S) : Masahiko OKAMURA

It is certified that error appears in the above-identified patent and that said Letters Patent is hereby corrected as shown below:

On the title page delete [*] notice:
This patent is subject to a terminal disclaimer.

Signed and Sealed this

Eighteenth Day of July, 2000

*Attest:*

Q. TODD DICKINSON

*Attesting Officer*

*Director of Patents and Trademarks*